US006845580B2

(12) United States Patent
Noble

(10) Patent No.: US 6,845,580 B2
(45) Date of Patent: Jan. 25, 2005

(54) REFLECTIVE SIGNAGE

(75) Inventor: Christopher D. Noble, Mooresville, NC (US)

(73) Assignee: Innovision Sports Marketing, Inc., Charlotte, NC (US)

( * ) Notice: Subject to any disclaimer, the term of this patent is extended or adjusted under 35 U.S.C. 154(b) by 170 days.

(21) Appl. No.: 09/973,576

(22) Filed: Oct. 9, 2001

(65) Prior Publication Data

US 2003/0066222 A1 Apr. 10, 2003

(51) Int. Cl.[7] ..... G09F 13/16
(52) U.S. Cl. ..... 40/582; 359/2
(58) Field of Search ..... 40/582; 359/2

(56) References Cited

U.S. PATENT DOCUMENTS 5,429,393 A * 7/1995 Parlo ..... 283/75
5,724,161 A * 3/1998 Smith et al. ..... 359/13
6,470,610 B1 * 10/2002 Northey ..... 40/582
6,543,163 B1 * 4/2003 Ginsberg ..... 40/219

OTHER PUBLICATIONS

Reflective holographic Christmas tree sign purchased at a Wal–Mart Department Store in Department 18, prior to the filing date of Applicant's application.

* cited by examiner

*Primary Examiner*—Cassandra Davis
(74) *Attorney, Agent, or Firm*—Alston & Bird LLP

(57) ABSTRACT

A sign comprising at least one support member and a body portion attached to the support member. The sign includes at least one reflective layer secured to the body portion. The sign includes at least one optically transmissive layer secured to the reflective layer such that the reflective layer is positioned between the optically transmissive layer and the body portion. The optically transmissive layer defines an interior portion, a border encompassing the interior portion, and at least one message positioned at least partially within the interior portion. The interior portion and the border comprise contrasting colors. The reflective layer is structured to reflect light through the optically transmissive layer to augment the contrast between the interior portion and the border to thereby enhance the visibility of the message.

11 Claims, 10 Drawing Sheets

REFLECTIVE SIGNAGE

FIELD OF THE INVENTION

The present invention relates to signage and, more particularly, relates to signage having improved visibility.

BACKGROUND OF THE INVENTION

Signs and banners are commonly used to identify and display a preference for, and support of, a team or individual in a sports competition, including, among others, football, basketball, baseball, soccer, tennis, rugby, track and field, swimming, or motor vehicle racing. Such signage also is used in connection with other types of entertainment events, such as concerts, as well as at political rallies and other gatherings and social events. Conventional signage typically is constructed of plastic, metal, paper, wood and/or cloth and usually includes a desired "message" permanently printed, adhered or otherwise placed thereon. The message generally comprises a written or other visual representation. For example, the message can include a slogan, a person's name, a team name, or a logo. Although such signage is relatively inexpensive to manufacture, the visibility of such signage can be decreased where there are a number of similar competing signs and/or in environments having reduced lighting, whether due to weather or nightfall. One proposed solution to increase the visibility of conventional signage has been to use relatively intense colors. However, such a solution is not always practical, especially where the desired message is a logo requiring a particular color motif or trade dress.

Accordingly, there is a need for improved signage having high visibility. The signage should be inexpensive to manufacture, allow for the permanent placement of a desired message, be capable of supporting variations in color motifs and be easily recognizable in relatively dim lighting conditions and when used with other competing signs.

SUMMARY OF THE INVENTION

The present invention provides a sign having improved visibility for displaying a message. According to one embodiment, the sign comprises at least one support member and a body portion secured to the at least one support member for positioning the body portion at a predetermined elevation. In one embodiment, the support member defines a curved portion for frictionally engaging the body portion. In another embodiment, the support member defines a wire-like member. The body portion can have a variety of configurations. In one embodiment, the body portion has a configuration selected from the group including a circle, an oval, a triangle, a square, a rectangle, a pentagon, a hexagon, a heptagon, an octagon, a nonagon, a decagon, a motor vehicle, a football, a football helmet, a bottle, a numeric character, or an alphabetic character. The body portion can be formed of polypropylene.

The sign includes at least one reflective layer at least partially secured to the body portion. The reflective layer defines a holographic pattern. In one embodiment, the reflective layer comprises a polyester hologram foil. In another embodiment, the reflective layer defines a pattern comprising a plurality of characters, including numeric characters and/or alphabetic characters. In another embodiment, the reflective layer defines a broken-glass pattern. In still another embodiment, the reflective layer defines a box pattern. In yet another embodiment, the reflective layer defines a circular pattern.

In one embodiment, the sign also includes at least one optically transmissive layer at least partially secured to the at least one reflective layer such that the reflective layer is at least partially positioned between the optically transmissive layer and the body portion. The optically transmissive layer can be formed of clear polyester or polypropylene. The optically transmissive layer defines at least one message. In one embodiment, the message comprises at least one graphic design, numeric character, or alphabetic character. According to this embodiment, the reflective layer is structured to reflect light through the optically transmissive layer to thereby visibly display the plurality of holographic characters defined by the reflective layer and to enhance the visibility of the message defined by the optically transmissive layer.

In another embodiment, the optically transmissive layer defines an interior portion, a border encompassing the interior portion, and at least one message positioned at least partially within the interior portion. The interior portion and the border comprise contrasting colors. According to this embodiment, the reflective layer is structured to reflect light through the optically transmissive layer to augment the contrast between the interior portion and the border defined by the optically transmissive layer to thereby enhance the visibility of the message positioned at least partially within the interior portion.

In yet another embodiment, the message is printed directly onto the at least one reflective layer such that the reflective layer is structured to reflect light about the message to visibly display said plurality of characters and enhance the visibility of said message. In still another embodiment, the reflective layer defines an interior portion, a border encompassing the interior portion, and at least one message positioned at least partially within the interior portion. The interior portion and the border comprise contrasting colors. According to this embodiment, the reflective layer is structured to reflect light so as to augment the contrast between the interior portion and the border defined by the reflective layer to thereby enhance the visibility of the message positioned at least partially within the interior portion.

Accordingly, the present invention provides an improved sign having high visibility. The sign is inexpensive to manufacture, allows for the permanent placement of a desired message, is capable of supporting variations in color motifs and is easily recognizable in relatively dim lighting conditions and when used with other competing signs.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, and which are not necessarily drawn to scale, wherein.

DETAILED DESCRIPTION OF THE INVENTION

Figure 1:
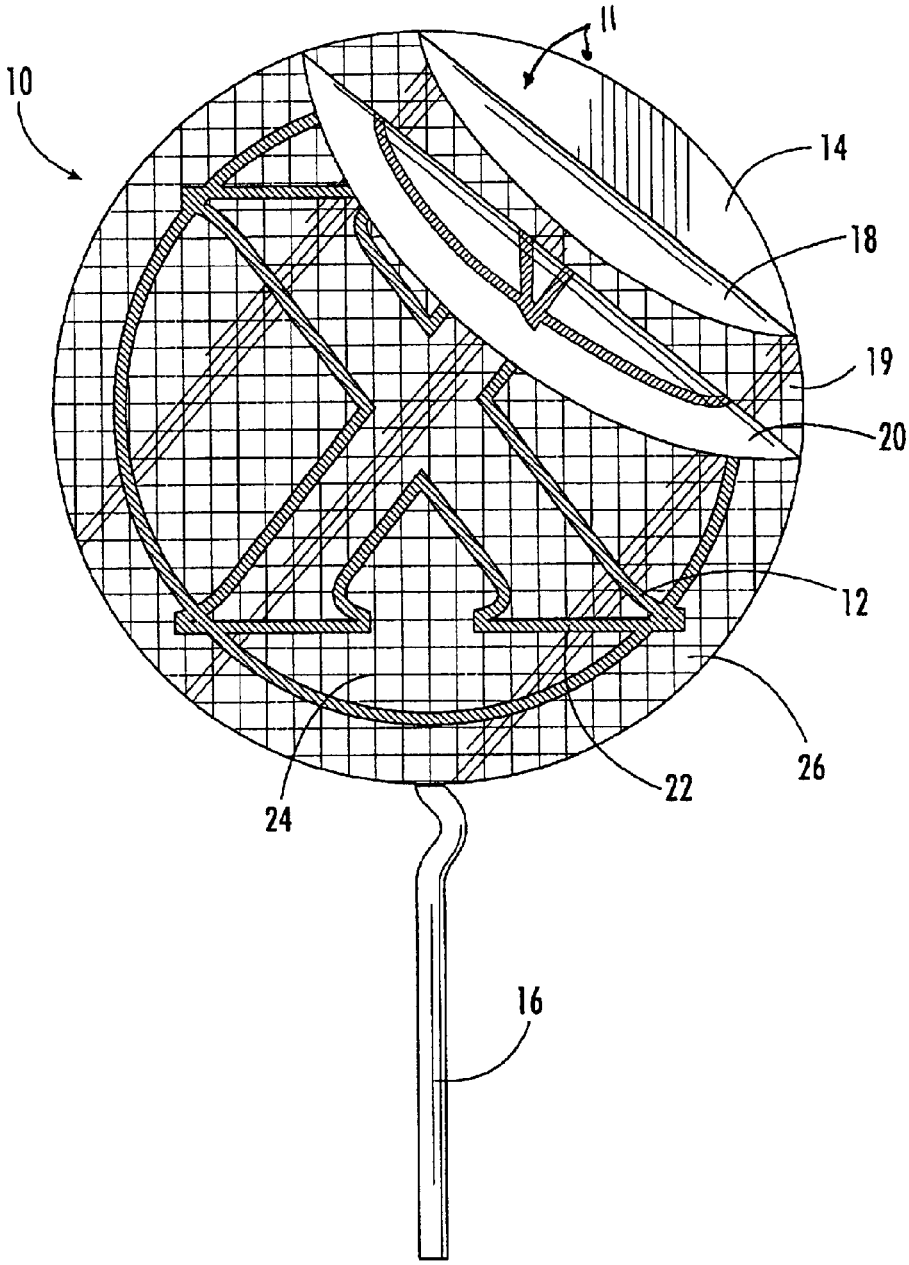
FIG. 1 is a partially exploded elevation view illustrating the body portion, reflective layer and optically transmissive layer of a sign, according to one embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Referring to the drawings and, in particular, to FIGS. 1, 2, 5 and 6 there are illustrated signs 10 having improved visibility for displaying a message 12, according to two embodiments of the present invention. Each sign 10 includes a body portion 14. In the illustrated embodiments, the body portion 14 is relatively thin thereby defining two relatively flat, symmetrical surfaces 11. In other embodiments (not shown), the body portion 14 can have a three dimensional shape or configuration, provided the body portion includes at least one relatively flat surface 11. The body portion 14 can be formed of a variety of lightweight materials, including plastic, metal, wood or composite materials. In one embodiment, the body portion 14 is formed of polypropylene, such as COROPLAST fluted polypropylene available from Great Pacific Enterprises, Inc. of Vancouver, Canada. The body portion 14 can be formed in a variety of colors depending on the particular application. For example, in one embodiment the body portion 14 is formed of black polypropylene. In another embodiment, the body portion 14 is formed of white polypropylene. While not intending to be bound by any specific theory or explanation, it is believed that white polypropylene absorbs less heat and ultraviolet light thereby providing the body portion 14 with greater resistance to warping.

The configuration of the body portion 14 can vary depending on the particular application for which the sign 10 is to be used. For purposes of example only and not limitation, the body portion 14 can have a circular configuration, as illustrated in FIGS. 1, 2, 5 and 6, or an elliptical or oval configuration. In other embodiments, as illustrated in FIGS. 3A–3J, the body portion 14 can be formed in the shape of a polygon, including, but not limited to, a triangle, square, rectangle, rhombus, trapezoid, pentagon, hexagon, heptagon, octagon, nonagon, or decagon. For applications involving sports competitions such as motor vehicle races, the body portion 14 can be configured in the shape of a motor vehicle, such as an automobile or boat, as illustrated in FIGS. 3K and 3L, respectively. In other embodiments (not shown), the body portion can be configured in the shape of an airplane or motorcycle. For other types of sports competitions, the body portion 14 can be configured in the shape of a piece of equipment associated with the particular sport. For example, as illustrated in FIGS. 3M, 3N, and 3O, the body portion can be configured in the shape of a football, football helmet, or basketball, respectively. Other types of sporting equipment configurations are also possible, including a baseball, a baseball bat, a baseball glove, a baseball hat, a soccer ball, and others, all of which are considered to be within the scope of the present invention. In another embodiment, the body portion 14 can be configured in the shape of an article associated with a sponsor of an event. For example, as illustrated in FIG. 3P, the body portion 14 can be configured in the shape of a bottle where the sponsor of an event is a beverage manufacturer or distributor. In still another embodiment, the body portion 14 comprises a character "X", as illustrated in FIG. 3Q, where "X" represents numeric characters and/or alphabetic character that are associated with a particular individual or team.

Figure 4:
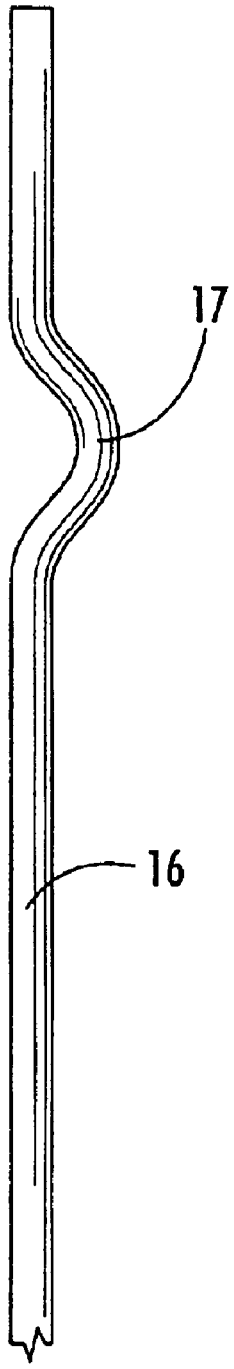
FIG. 4 is an elevation view illustrating the curved portion of the support member, according to one embodiment of the present invention.

As illustrated in FIGS. 1, 2, 5 and 6, the sign 10 preferably includes at least one support member 16 attached to the body portion 14, or formed integrally therewith, for positioning the body portion at a predetermined elevation. The support member 16 can be formed of a variety of lightweight materials, including plastic, metal, wood, fiber or composite materials. In one embodiment, the support member 16 comprises a metal rod that is inserted into an aperture defined on the edge of the body portion 14 of the sign 10. For example, as illustrated in FIGS. 1, 2, 5 and 6, where the body portion 14 comprises a fluted polypropylene, the body portion defines a plurality of apertures along the edge. As illustrated in FIG. 4, the support member 16 can include a curved portion 17 that frictionally engages the corresponding aperture in the body portion 14 to prevent the body portion from becoming detached from the support member. In another embodiment (not shown), the support member 16 comprises a wire-like member, such as a metal wire or a thread or string, as is known in the art. According to this embodiment, one end of the support member 16 can be tied to the body portion 14 through an aperture or the like in the body portion and the other end of the support member can be tied to a beam or other support to hang the body portion at the desired elevation. In still another embodiment (not shown), the sign 10 does not include a support member 16.

The sign 10 includes at least one reflective layer 18 at least partially secured to the body portion 14. Where the body portion 14 of the sign 10 defines multiple relatively flat surfaces 11, preferably at least one reflective layer 18 is at least partially secured to each surface. For example, as illustrated in FIGS. 1, 2, 5 and 6, the body portion 14 has a thickness of less than about 0.25 inches and defines two symmetrical, relatively flat surfaces 11. According to this embodiment, preferably a corresponding reflective layer 18 is at least partially secured to each of the two surfaces 11 defined by the body portion 14. Each reflective layer 18 defines a holographic pattern 19. According to one embodiment, the reflective layer 18 is preferably formed of a polyester hologram foil that is laminated to the surface of the body portion 14. A suitable polyester hologram foil is available from Amagic Holographics, Inc. of Irvine, Calif.

Figure 7A:
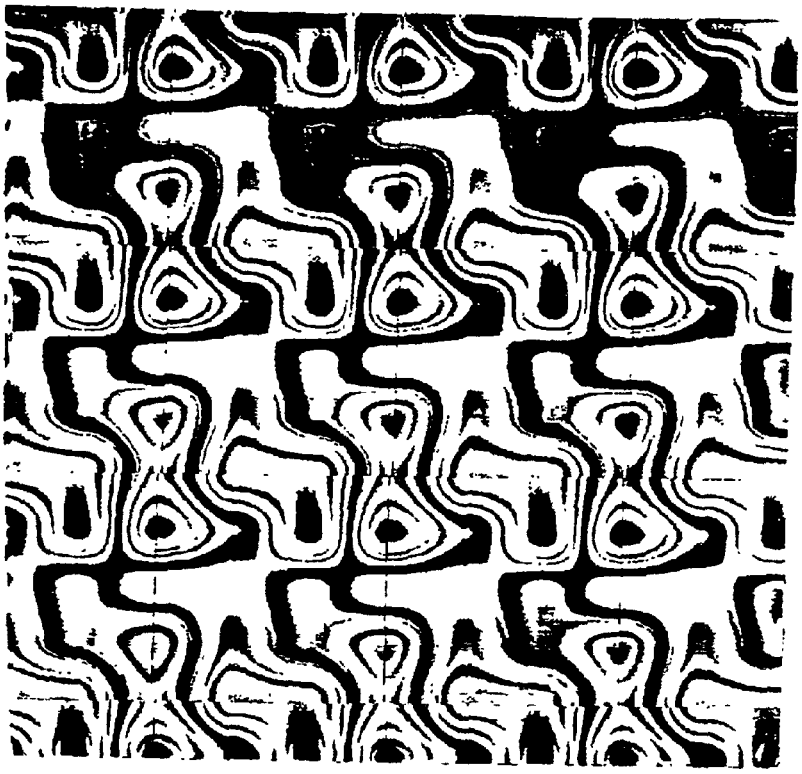
FIGS. 7A–7E are photocopies of exemplary holographic patterns, according to various embodiments of the invention.
Figure 7B:
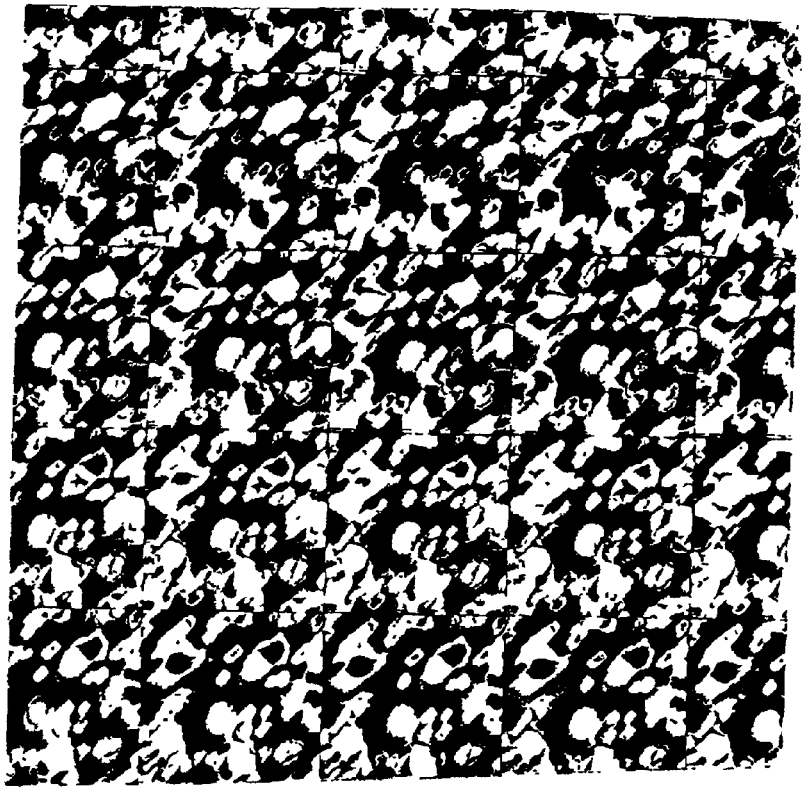
Figure 7C:
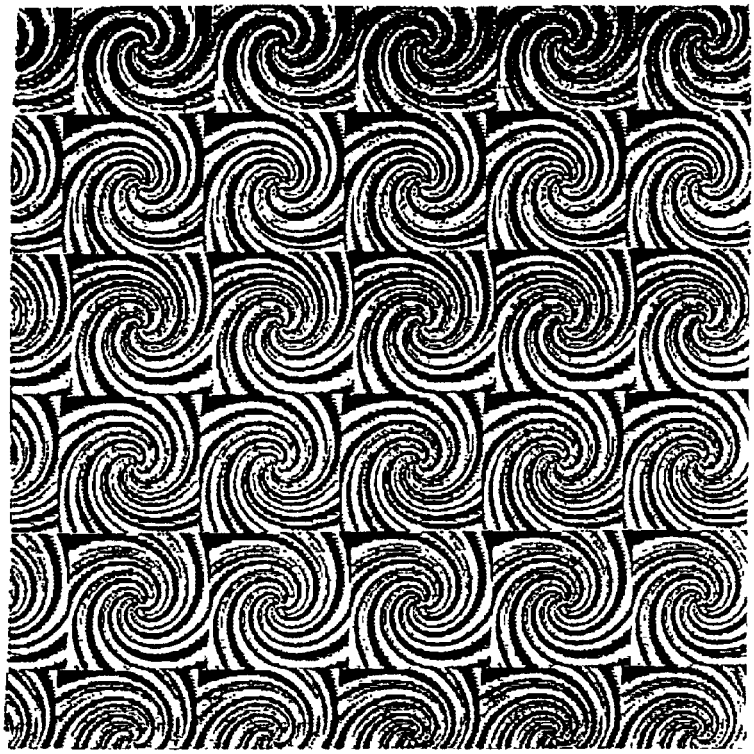
Figure 7D:
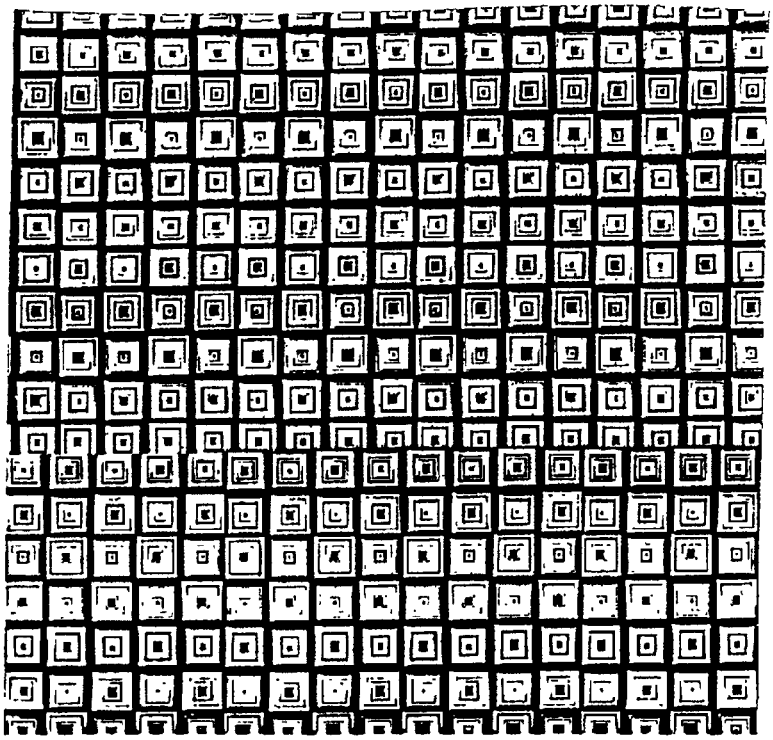
Figure 7E:
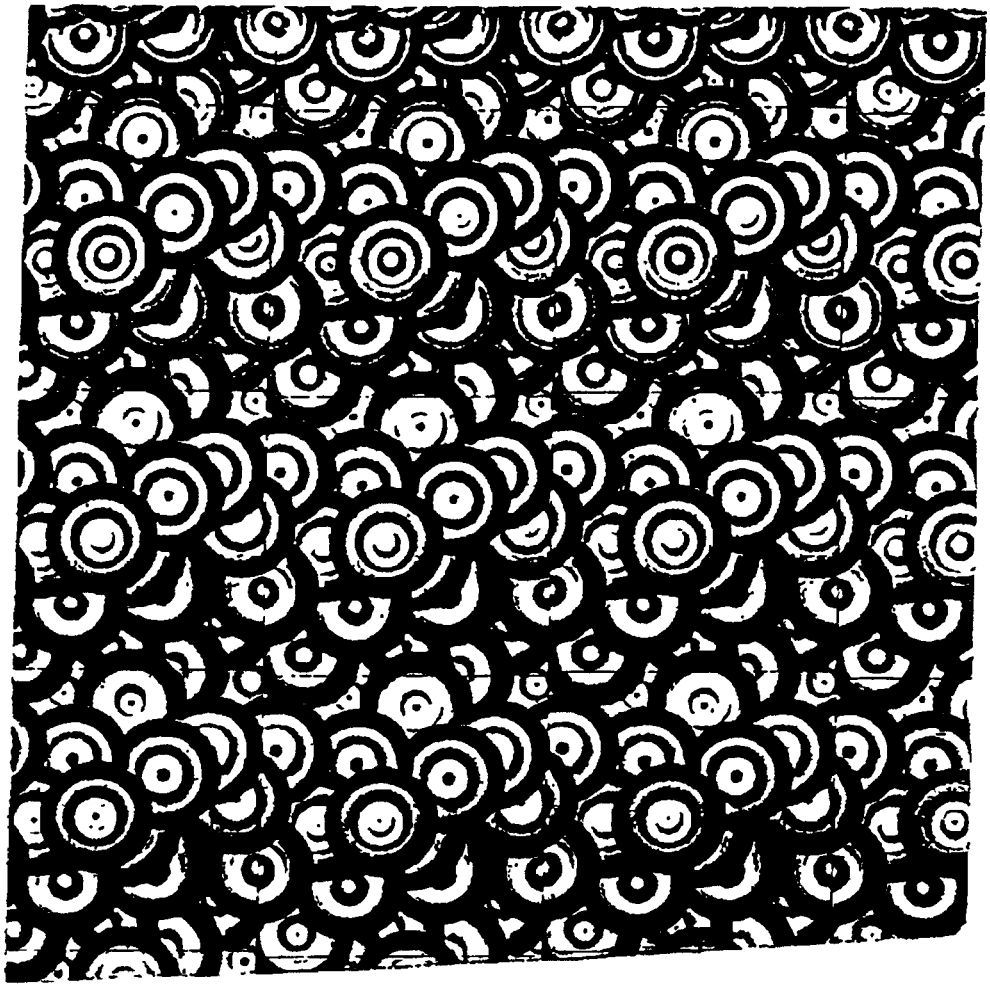

As illustrated in FIGS. 7A–7E, the holographic pattern 19 defined by the reflective layer 18 can vary depending on the particular application for which the sign 10 is to be used. For purposes of example only and not limitation, the pattern 19 defined by the reflective layer 18 can comprise a plurality of recurring characters "X", as illustrated in FIG. 2, where "X" represents numeric characters, alphabetic characters or graphic designs. In another embodiment, as illustrated in FIGS. 1 and 7D, the pattern 19 can include a "box" pattern or, as illustrated in FIGS. 7C and 7E, a "circular" pattern.

Other relatively random patterns such as the patterns illustrated in FIGS. 7A and 7B, as well as a "broken glass" pattern (not shown), can be formed. Other patterns 19 can be formed using circular shapes or polygons, as well as graphic designs and logos, all of which are considered to be within the scope of the present invention. The pattern 19 defined by the reflective layer 18 can also be colored depending on the particular application for which the sign 10 is to be used.

Figure 2:
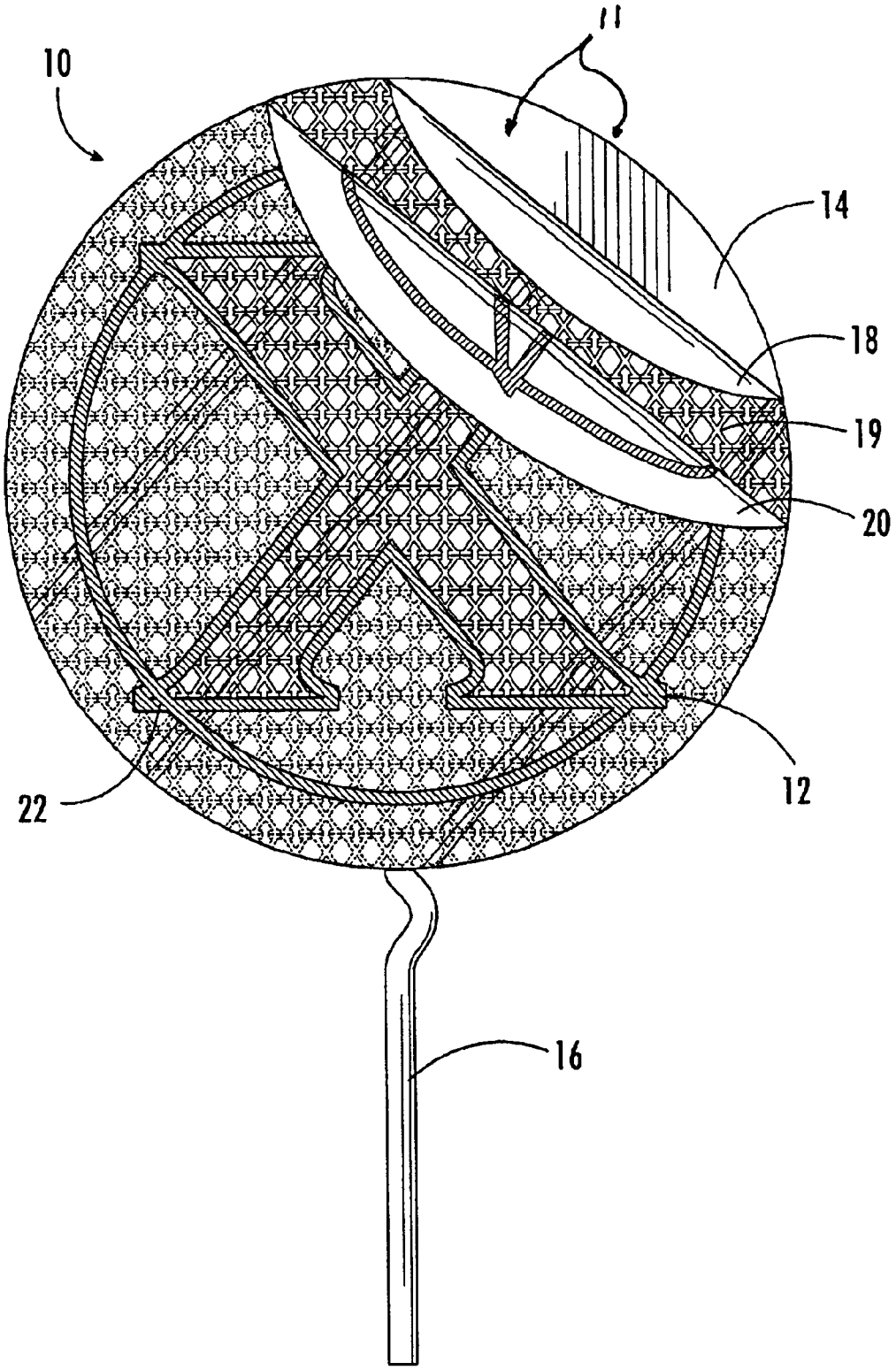
FIG. 2 is a partially exploded elevation view illustrating the body portion, reflective layer and optically transmissive layer of a sign, according to another embodiment of the present invention.
Figure 3A:
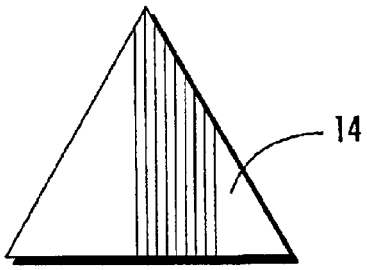
FIGS. 3A–3Q are elevation views illustrating alternative configurations of the body portion, according to various embodiments of the present invention.
Figure 3B:
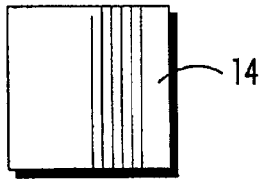
Figure 3C:
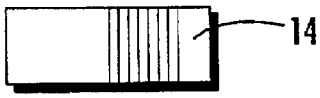
Figure 3D:
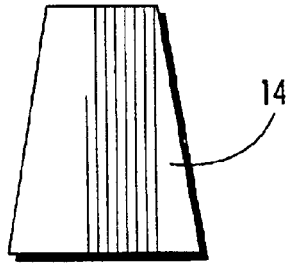
Figure 3E:
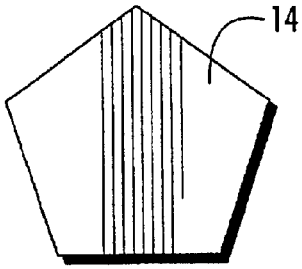
Figure 3F:
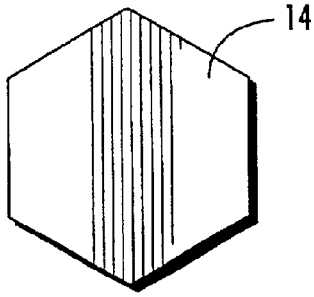
Figure 3G:
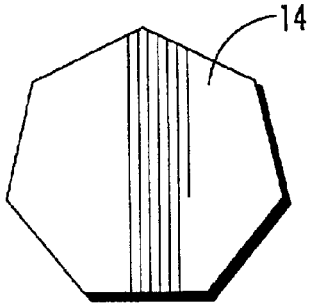
Figure 3H:
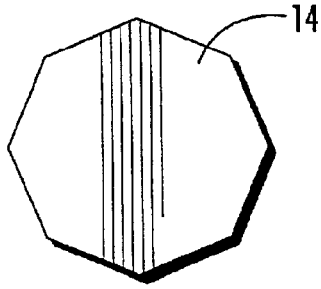
Figure 3I:
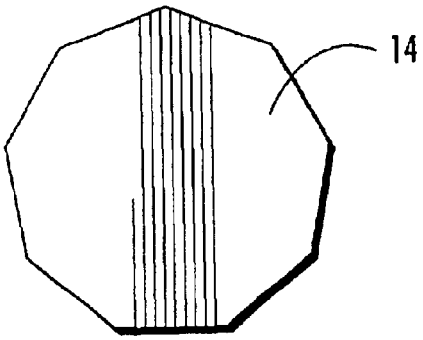
Figure 3J:
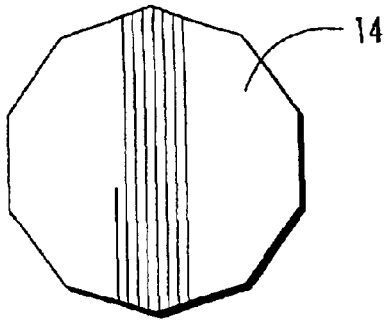
Figure 3K:
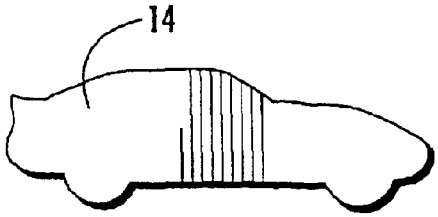
Figure 3L:
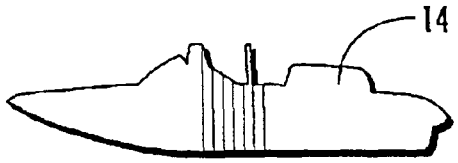
Figure 3M:
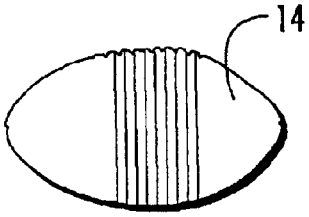
Figure 3N:
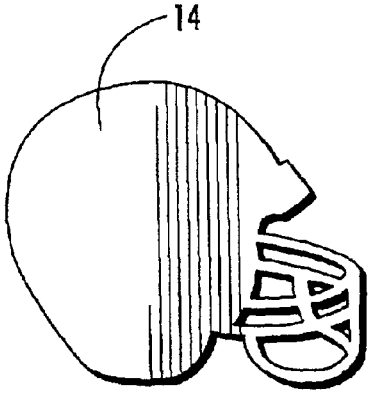
Figure 3O:
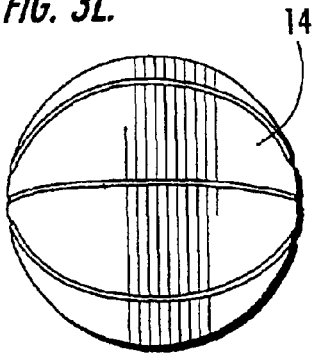
Figure 3P:
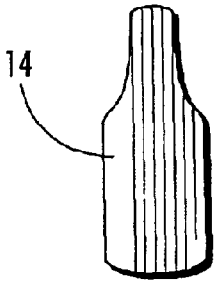
Figure 3Q:
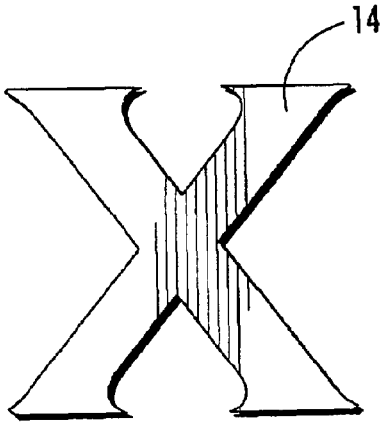

As illustrated in FIGS. 1 and 2, the sign 10 can also include at least one optically transmissive layer 20 at least partially secured to the reflective layer 18 such that the reflective layer is at least partially positioned between the optically transmissive layer and the body portion 14. As discussed above, where the body portion 14 of the sign 10 defines multiple relatively flat surfaces each having one or more reflective layers 18 at least partially secured thereto, then at least one optically transmissive layer 20 is at least partially secured to each corresponding reflective layer. The optically transmissive layer 20 defines at least one message 22. In one embodiment, the message 22 is silk screen printed onto the optically transmissive layer. In other embodiments, the message 22 can be printed on the optically transmissive layer using off-set printing or using flex-o-graphic or flexo printing. Using any of this printing methods, a variety of messages and color motifs can be obtained. The optically transmissive layer 20 preferably is formed of a clear polyester or polypropylene, which can be laminated to the corresponding reflective layer(s) 18.

The message 22 defined by the optically transmissive layer 20 will vary depending on the particular application for which the sign 10 is to be used. For purposes of example only and not limitation, the message 22 defined by the optically transmissive layer 20 is represented by the "X" in FIGS. 1 and 2, where "X" represents one or more graphic designs, numeric characters, or alphabetic characters. In another embodiment, as illustrated in FIG. 1, the optically transmissive layer 20 may also define an interior portion 24, a border 26 encompassing the interior portion, and at least one message 22 positioned at least partially within the interior portion. The message 22, or portions thereof, can be positioned entirely within the interior portion 24 or in both the interior portion and border 26. Other messages 22 can be positioned solely within the border 26. The interior portion 24 and the border 26 preferably comprise contrasting colors. In one preferred embodiment, the border 26 is a symmetric circle or square that directs and focuses, in combination with the light being reflected by the corresponding reflective layer 18, a viewer's attention to the message within the interior portion 24.

According to the embodiments illustrated in FIGS. 1 and 2, each corresponding reflective layer 18 is structured to receive light through the optically transmissive layer 20 and deflect the light back through the optically transmissive layer in the holographic pattern 19 defined by the reflective layer. More specifically, where the reflective layer 18 defines a pattern 19 of recurring holographic characters, the reflective layer is structured to reflect light through the corresponding optically transmissive layer(s) 20 to thereby visibly display the plurality of holographic characters defined by the reflective layer and to enhance the visibility of the message 22 defined by the optically transmissive layer. In an embodiment in which the optically transmissive layer 20 defines an interior portion 24 and a border 26, the reflective layer 18 is structured to reflect light through the optically transmissive layer to augment the contrast between the interior portion and the border to thereby enhance the visibility of the message positioned within the interior portion.

Figure 5:
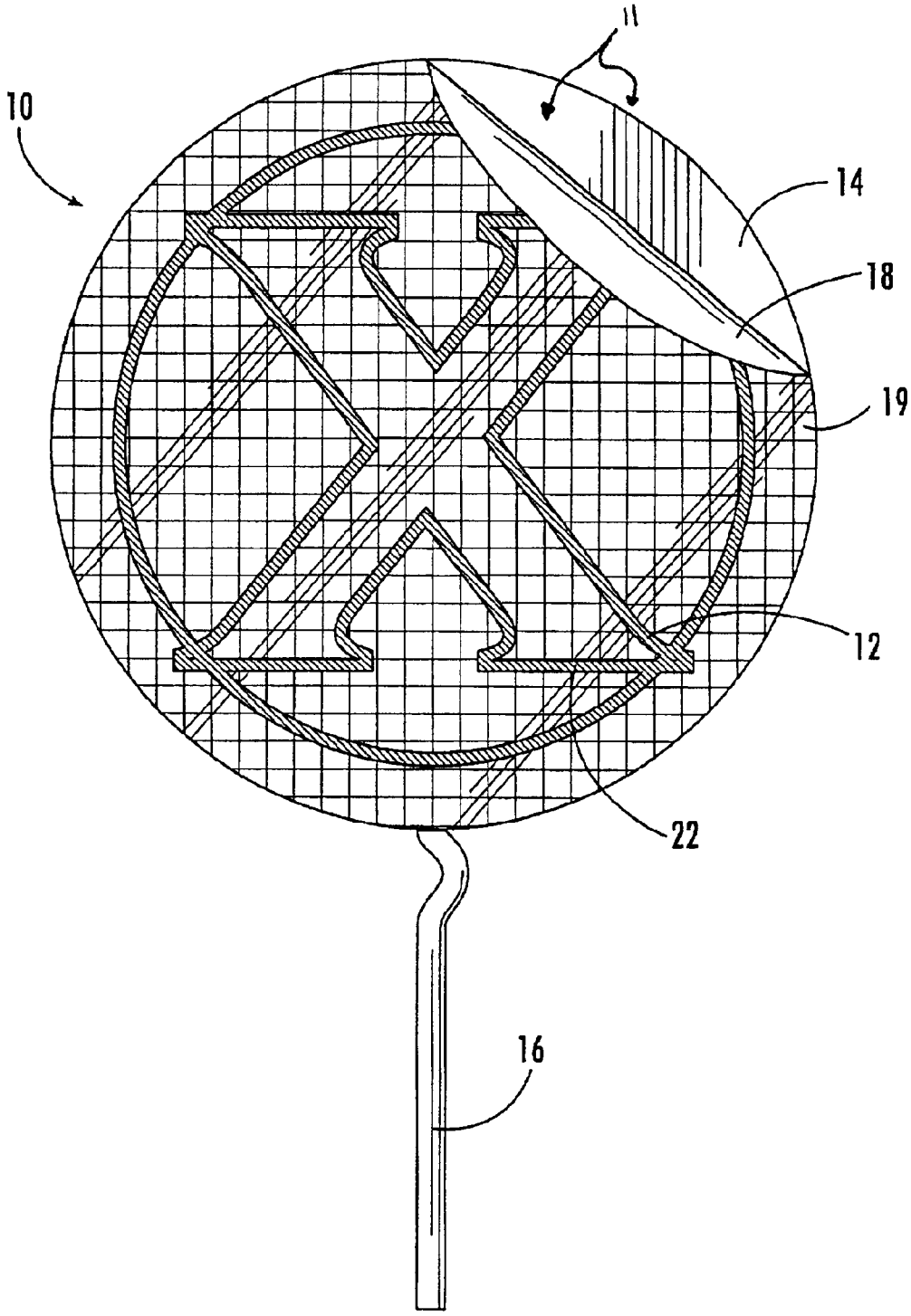
FIG. 5 is a partially exploded elevation view illustrating the body portion and reflective layer of a sign, according to one embodiment of the present invention.
Figure 6:
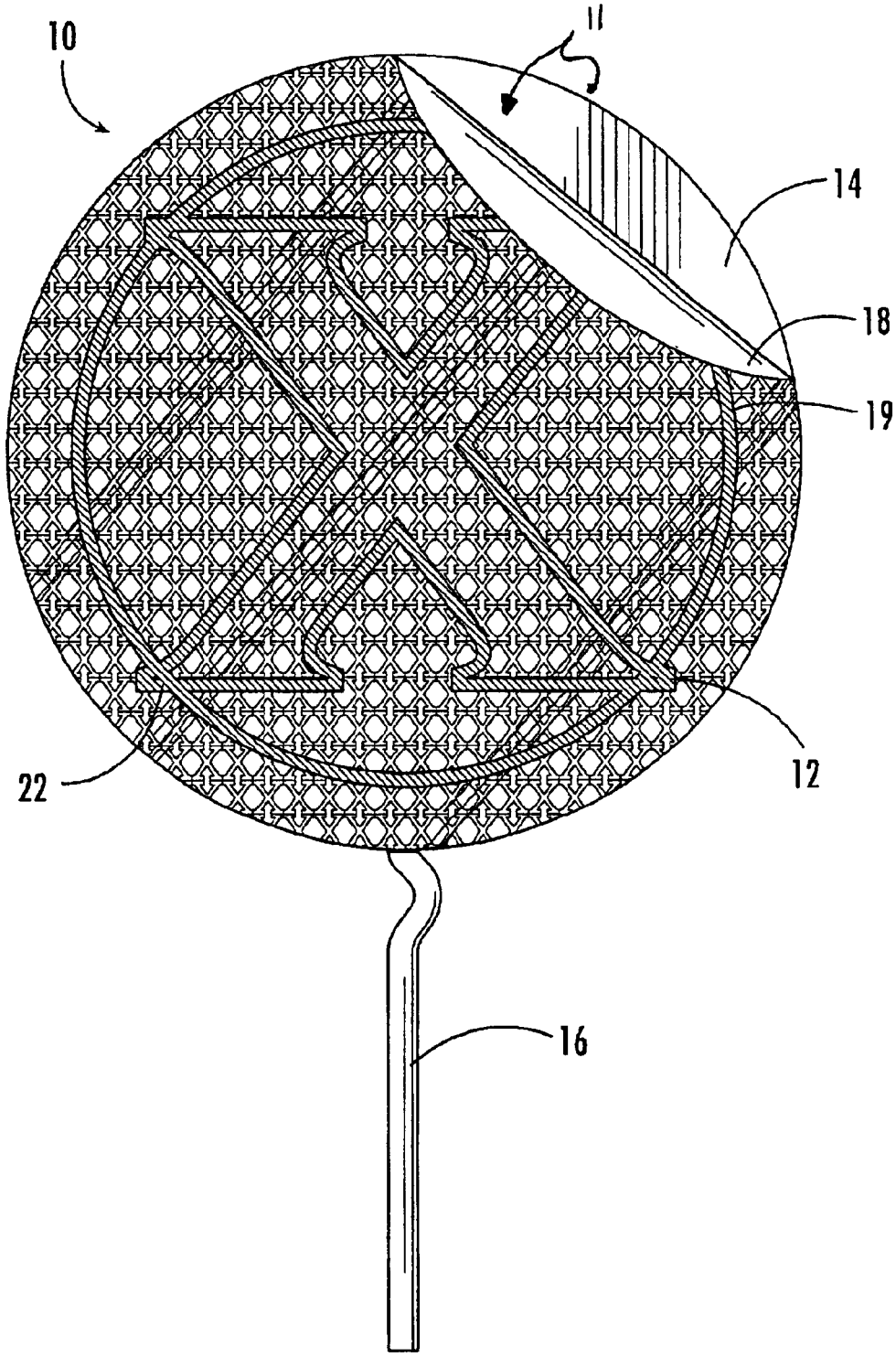
FIG. 6 is a partially exploded elevation view illustrating the body portion and reflective layer of a sign, according to another embodiment of the present invention.

In other embodiments of the invention, as illustrated in FIGS. 5 and 6, the reflective layer 18 defines at least one message 22 thereby eliminating the necessity of the optically transmissive layer. As discussed above, the message 22 can be silk screen printed onto the reflective layer 18. In other embodiments, the message 22 can be printed on the reflective layer 18 using off-set printing or using flex-o-graphic or flexo printing. The message 22 defined by the reflective layer 18 will vary depending on the particular application for which the sign 10 is to be used. As discussed above, the message 22 defined by the reflective layer 18 is represented by the "X" in FIGS. 5 and 6, where "X" represents one or more graphic designs, numeric characters, or alphabetic characters. In another embodiment, as illustrated in FIG. 5, the reflective layer 18 may also define an interior portion 24, a border 26 encompassing the interior portion, and at least one message 22 positioned at least partially within the interior portion. The message 22, or portions thereof, can be positioned entirely within the interior portion 24 or in both the interior portion and border 26. Other messages 22 can be positioned solely within the border 26. The interior portion 24 and the border 26 preferably comprise contrasting colors. In one preferred embodiment, the border 26 is a symmetric circle or square that directs and focuses, in combination with the light being reflected by the corresponding reflective layer 18, a viewer's attention to the message within the interior portion 24.

According to the embodiments illustrated in FIGS. 5 and 6, each corresponding reflective layer 18 is structured to deflect light in the holographic pattern 19 defined by the reflective layer. More specifically, where the reflective layer 18 defines a pattern 19 of recurring holographic characters, the reflective layer is structured to reflect light to thereby visibly display the plurality of holographic characters defined by the reflective layer and to enhance the visibility of the message 22 defined by reflective layer. In an embodiment in which the reflective layer 18 defines an interior portion 24 and a border 26, the reflective layer 18 is structured to reflect light to augment the contrast between the interior portion and the border to thereby enhance the visibility of the message positioned within the interior portion.

Thus, the present invention provides an improved sign having high visibility. The sign is inexpensive to manufacture, allows for the permanent placement of a desired message, is capable of supporting variations in color motifs and is easily recognizable in relatively dim lighting conditions and when used with other competing signs. Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A sign, comprising:

at least one support member;

a body portion, said body portion being attached to said at least one support member for positioning said body portion at a predetermined elevation;

at least one reflective layer at least partially secured to said body portion, said at least one reflective layer comprising a polyester hologram foil and defining a holographic pattern; and at least one optically transmissive layer at least partially secured to said at least one reflective layer such that said at least one reflective layer is at least partially positioned between said at least one optically transmissive layer and said body portion, said at least one optically transmissive layer defining an interior portion, a border encompassing said interior portion, and at least one message positioned at least partially within said interior portion, said interior portion and said border comprising contrasting colors, and wherein said at least one reflective layer is structured to reflect light through said at least one optically transmissive layer to augment the contrast between said interior portion and said border to thereby enhance the visibility of said message.

2. A sign according to claim 1 wherein said body portion is formed of polypropylene.

3. A sign according to claim 1 wherein said body portion has a configuration selected from the group consisting of a circle, an oval, a triangle, a square, a rectangle, a pentagon, a hexagon, a heptagon, an octagon, a nonagon, a decagon, a motor vehicle, a football, a football helmet, a bottle, a numeric character, and an alphabetic character.

4. A sign according to claim 1 wherein said pattern of said at least one reflective layer comprises a plurality of characters selected from the group consisting of numeric characters and alphabetic characters.

5. A sign according to claim 1 wherein said at least one reflective layer defines a broken-glass pattern.

6. A sign according to claim 1 wherein said at least one reflective layer defines a box pattern.

7. A sign according to claim 1 wherein said at least one reflective layer defines a circular pattern.

8. A sign according to claim 1 wherein said message comprises at least one graphic design, numeric character, and alphabetic character.

9. A sign according to claim 1 wherein said at least one support member defines a curved portion for frictionally engaging said body portion.

10. A sign according to claim 1 wherein said at least one support member defines a wire-like member.

11. A sign according to claim 1 wherein said at least one optically transmissive layer comprises a material selected from the group consisting of polyester and polypropylene.

* * * * *